US010309406B2

(12) United States Patent
Fujita

(10) Patent No.: US 10,309,406 B2
(45) **Date of Patent: *Jun. 4, 2019**

(54) CENTRIFUGAL BLOWING FAN

(71) Applicant: MINEBEA MITSUMI INC., Kitasaku-gun, Nagano (JP)

(72) Inventor: Kazuhiko Fujita, Kakegawa (JP)

(73) Assignee: MINEBEA MITSUMI INC., Nagano (JP)

( * ) Notice: Subject to any disclaimer, the term of this patent is extended or adjusted under 35 U.S.C. 154(b) by 358 days.

This patent is subject to a terminal disclaimer.

(21) Appl. No.: 15/160,320

(22) Filed: May 20, 2016

(65) Prior Publication Data

US 2016/0265543 A1 Sep. 15, 2016

Related U.S. Application Data

(63) Continuation of application No. 13/903,532, filed on May 28, 2013, now Pat. No. 9,371,840.

(30) Foreign Application Priority Data

May 29, 2012 (JP) ..... 2012-122300

(51) Int. Cl.
*F04D 17/16* (2006.01)
*F04D 25/06* (2006.01)
(Continued)

(52) U.S. Cl.
CPC ..... *F04D 25/0613* (2013.01); *F04D 17/16* (2013.01); *F04D 29/056* (2013.01);
(Continued)

(58) Field of Classification Search
CPC .... F04D 25/0613; F04D 17/16; F04D 29/056; F04D 29/282; F04D 29/4226; F04D 29/626
See application file for complete search history.

(56) References Cited

U.S. PATENT DOCUMENTS 5,328,332 A * 7/1994 Chiang ..... F04D 29/281 416/186 R
6,146,094 A * 11/2000 Obana ..... F04D 29/023 415/200
(Continued)

FOREIGN PATENT DOCUMENTS

JP S63-65896 U 4/1988
JP H06-299995 A 10/1994
(Continued)

OTHER PUBLICATIONS

Feb. 24, 2016 Office Action issued in Japanese Patent Application No. 2012-122300.

*Primary Examiner* — Woody A Lee, Jr.
(74) *Attorney, Agent, or Firm* — Peame & Gordon LLP

(57) ABSTRACT

A centrifugal blowing fan comprises a back yoke made from metal, having a substantially bottomed cylindrical portion around a rotating shaft of a motor, an inner surface attached with a magnet of the motor mounted thereon and a flange portion disposed around a periphery of an opening of the cylindrical portion; and a cylindrical impeller made from resin, having a plurality of blades circumferentially arranged, an annular collar portion joined with first ends of the plurality of blades and a doughnut-shaped disk portion joined with second ends of the plurality of blades, wherein the disk portion has at least one fitting, and the flange portion has at least one fitted space receiving the at least one fitting so as to concentrically and fixedly connect the impeller 16 and the back yoke.

4 Claims, 7 Drawing Sheets

(51) Int. Cl.

| | |
|---|---|
| ***F04D 29/42*** | (2006.01) |
| ***F04D 29/28*** | (2006.01) |
| ***F04D 29/62*** | (2006.01) |
| ***F04D 29/056*** | (2006.01) |

(52) U.S. Cl.
CPC ..... *F04D 29/282* (2013.01); *F04D 29/4226* (2013.01); *F04D 29/626* (2013.01)

(56) References Cited

U.S. PATENT DOCUMENTS

| | | | | |
|---|---|---|---|---|
| 6,386,831 | B1 * | 5/2002 | Stahl | F04D 29/281 29/889.21 |
| 6,488,485 | B1 * | 12/2002 | Rupp | F04D 25/0613 415/119 |
| 6,805,531 | B2 * | 10/2004 | Iida | B29C 45/0062 415/206 |
| 6,979,177 | B2 * | 12/2005 | Lin | F04D 25/0613 310/156.26 |
| 2004/0191088 | A1 * | 9/2004 | Matsumoto | F04D 25/0613 417/354 |
| 2007/0014675 | A1 * | 1/2007 | Nagamatsu | F04D 25/0613 417/354 |
| 2008/0112810 | A1 | 5/2008 | Nagamatsu et al. | |

FOREIGN PATENT DOCUMENTS

| | | | |
|---|---|---|---|
| JP | H107-75288 | A | 3/1995 |
| JP | H07-332290 | A | 12/1995 |
| JP | 2004-052735 | A | 2/2004 |
| JP | 2004-092446 | A | 3/2004 |
| JP | 2007-023877 | A | 2/2007 |

* cited by examiner

CENTRIFUGAL BLOWING FAN

This is a Continuation of application Ser. No. 13/903,532 filed May 28, 2013, which claims the benefit of Japanese Patent Application No. 2012-122300 filed May 29, 2012. The disclosure of the prior applications are hereby incorporated by reference herein in their entireties.

TECHNICAL FIELD

The present invention relates to a centrifugal blowing fan, in particular, a centrifugal blowing fan for radially exhausting air axially taken therein, having an improved structure for fixedly connecting an impeller and a back yoke.

BACKGROUND ART

Conventionally, in a structure for fixedly connecting an impeller and a back yoke of an outer rotor centrifugal blowing fan, a back yoke made from metal was joined to an accommodation being formed integrally with an inner circumferential portion of an impeller made from resin by means of inserting and/or thermal adhesion. However, the expansion of applications has required that such centrifugal blowing fan is in use under severe environment, whereat the problem arises that the accommodation is damaged due to the difference of thermal shrinkage between the accommodation made from resin and the back yoke made from metal. Further, forced draft cooling under a fitted space-saying condition and consequently miniaturization of the centrifugal blowing fan are required.

To solve this problem, known are examples in which a structure is adopted where an impeller and a back yoke are connected instead of covering an outer circumference of the back yoke with an accommodation made from (See, for example, Patent Literature 1, Patent Literature 2 and Patent Literature 3).

Patent Literature 1 discloses a structure where a ring portion made from resin is insert-molded into an opening or an outer surface of a back yoke made from metal, and further an impeller is ultrasonic-welded to the ring portion to fixedly connect the impeller and the back yoke.

Patent Literature 2 discloses a structure where a back yoke and an impeller are integrally formed from one steel plate.

Patent Literature 3 discloses a structure where a flange portion is provided at an opening of a back yoke, and blades of an impeller made from metal are mounted on the flange portion. In this structure, the blades are made from metal, and those blades need to be mounted on the flange portion one by one.

Since, however, the technique according to Patent Literature 1 discloses a structure where the ring portion made from resin is insert-molded into the opening or the outer surface of the back yoke made from metal, followed by ultrasonic-welding the impeller to the ring portion, the technique would require a lot of man-hours, resulting in an increase in costs. That is; the back yoke formed by press working is set in a mold for insert-molding to mold the ring portion, and subsequently the impeller which has been made by a different process is integrated by ultrasonic-welding and the like with a member obtained by connecting the back yoke and the ring portion. In this case, it is needed to align the central axis of the impeller and the central axis of the back yoke, but it is not so easy to align the central axes since the impeller and the ring portion are different members. Therefore, even it for example, cross-sectional shapes of impeller blades are engraved on the ring portion, a work to place each of the blades in the engraved portions is still needed. This work requires a lot of man-hours much more compared to the conventional method, wherefore the increase in costs remains as a problem. Further, a location whereat the ring portion is connected with the back yoke is in the vicinity of the opening and/or the outer surface of the back yoke, which means that this location is near by a source of heat. Therefore, this involves the problem that the location would be subject to influence by heat.

The technique according to Patent Literature 2 discloses a structure where the back yoke and the impeller are integrally formed from one steel plate. However, this structure involves the problem that it is difficult to realize such structure in case of an impeller with a certain height or an impeller having a lot of blades.

The technique according to Patent Literature 3 discloses a structure where the flange portion is provided at the opening of the back yoke, and blades of the impeller made from metal are mounted on the flange portion. In this structure, the blades are made from metal, and the blades have to be mounted on the flange portion one by one. Therefore, this structure involves the problem that a lot of man-hours are required, resulting in an increase in costs.

CITATION LIST

Patent Literature

Patent Literature 1: Japanese Unexamined Patent Application Publication No. 2007-23877

Patent Literature 2: Japanese Unexamined Patent Application Publication No. 2004-52735

Patent Literature 3: Japanese Unexamined Patent Application Publication No. 06-299995

SUMMARY OF INVENTION

Technical Problem

The present invention has been made in view of the above problems. It is therefore an object of the present invention to provide a centrifugal blowing fan in which blowing capability can be enhanced by increasing an air blowing rate while number of parts and man-hours remain as before, and an impeller and a back yoke are tightly fixed and connected so as to prevent damage even under severe environment.

Solution to Problem

In accordance with an aspect of the present invention, a centrifugal blowing fan for radially exhausting air axially taken therein comprises: a back yoke made from metal, the back yoke having a substantially bottomed cylindrical portion around a rotating shaft of a motor, an inner surface attached with a magnet of the motor mounted thereon and a flange portion disposed around a periphery of an opening of the cylindrical portion, and the back yoke rotating integrally with the rotating shall; and a cylindrical impeller made from resin, the impeller having a plurality of blades circumferentially arranged, an annular collar portion joined with first ends of the plurality of blades and a doughnut-shaped disk portion joined with second ends of the plurality of blades, wherein the cylindrical portion of the back yoke has an outer diameter smaller than an inner diameter of the impeller, and the flange portion has an outer diameter substantially same to or slightly larger than an outer diameter of the disk portion of the impeller, and wherein the disk portion of the impeller has at least one fitting, and the flange portion of the back yoke has at least one fitted space receiving the at least one fitting so as to concentrically and fixedly connect the impeller and the back yoke in a state where the disk portion and the flange portion of the back yoke are joined.

It is preferred that the at least one fitting may comprise a plurality of fittings, the plurality of fittings being formed into a plurality of protrusions at substantially equal distances in a circumferential direction, and the at least one fitted spare comprises a plurality of fitted spaces, the plurality of fitted spaces being formed into a plurality of holes through the flange portion of the back yoke in a diameter substantially same to and at equal distances same to the protrusions of the impeller, such that the impeller and the back yoke are fixedly connected by swaging, on a back surface side of the flange portion, the plurality of protrusions inserted through the plurality of holes from a front surface side of the flange portion and protruded from the back surface side.

It is preferred that the at least one fitting may comprise a plurality of fittings, the plurality of fittings being formed into a plurality of claws in a honk shape at substantially equal distances in a circumferential direction, and the at least one fitted space comprises a plurality of fitted spaces, the plurality of fitted spaces being formed into a plurality of notches or holes in a diameter substantially same to and at equal distances same to the claws of the impeller, such that the impeller and the back yoke are fixedly connected by putting the claws of the fitting into the notches or the holes.

It is preferred that the at least one fitting may comprise a plurality of fittings, the plurality of fittings being formed into a plurality of locks at substantially equal distances in a circumferential direction, and the at least one fitted space comprises a plurality of fitted spaces, the plurality of tined spaces being formed into a plurality of notches or holes in a diameter substantially same to and at equal distances same to the locks of the impeller, such that the impeller and the back yoke are fixedly connected by putting the locks of the impeller into the notches or the holes of the back yoke and rotating the back yoke.

Advantageous Effects of Invention

The aspect of the present invention can provide a centrifugal blowing fan in which blowing capability can be enhanced by increasing an air blowing rate while number of parts and man-hours remain as before, and an impeller and a back yoke are tightly and fixedly connected so as to prevent damage even under severe environment.

BRIEF DESCRIPTION OF DRAWINGS

FIG. 5(*b*) is a cross-sectional view to explain a state that the back yoke and the impeller of the centrifugal blowing fan specified above after fixedly connected.

FIG. 10(*b*) is an enlarged view of circled B of FIG. 9, showing a cross-sectional view of C-C line of (a).

FIG. 10(*c*) is an enlarged view of circled B of FIG. 9, showing a state after fixedly connected.

FIG. 10(*d*) is an enlarged view of circled B of FIG. 9, showing a cross-sectional view of D-D line of (c).

DESCRIPTION OF EMBODIMENTS

Figure 1:
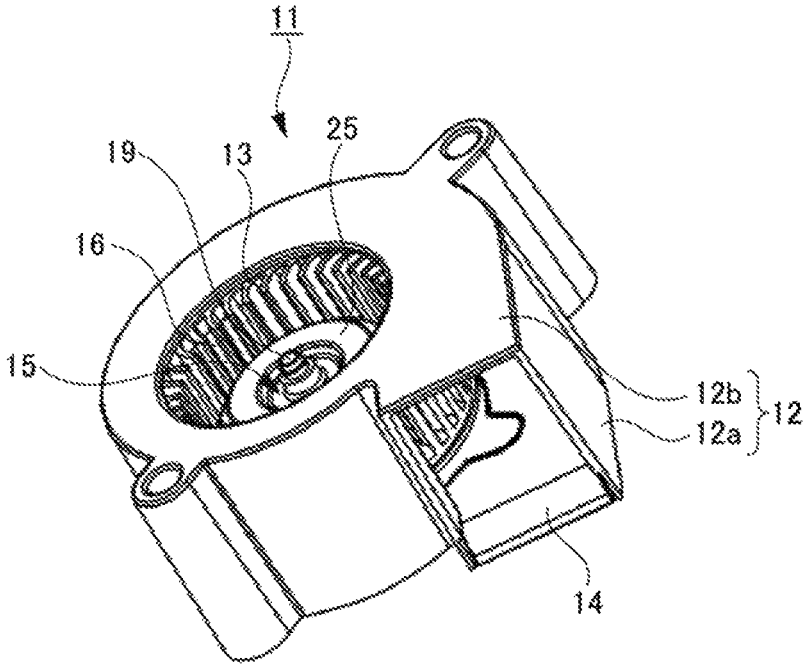
FIG. 1 is a perspective view of a centrifugal blowing fan according to a first embodiment of the present invention.

Now, embodiments for carrying out the present invention (hereafter referred to as "embodiments") will be described in detail with reference to the attached drawings. It should be noted that in the description of the present invention, expressions which indicate directions, such as upper, lower, right and left directions, should not be understood in an absolute sense but in a relative sense. These expressions are appropriate as long as they describe the positions of individual members, portions, parts or the like of centrifugal blowing fans according to embodiments as shown in the drawings. However, in case the positions of those members, portions, parts or the like are changed, the above expressions are to be interpreted accordingly.

FIG. 1 is a perspective view showing a centrifugal blowing fan of a first embodiment as a whole. According to this figure, the centrifugal blowing fan 11 comprises a scroll-shaped casing 12 comprising a body 12*a* and a lid 12*b*, wherein an air inlet 13 and an air outlet 14 is formed on the casing 12. The air inlet 13 is formed on the central portion of the lid 12*b* of the casing 12, and the air outlet 14 is formed on the side surface of the body 12*a*, which surface is virtually orthogonal to the lid 12*b*. Further, a motor 15 and an impeller 16 and so on are accommodated inside the casing 12.

FIGS. 2 to 6 show the structure of the motor 15 and the impeller 16 in the centrifugal blowing fan 11 in detail.

Figure 2:
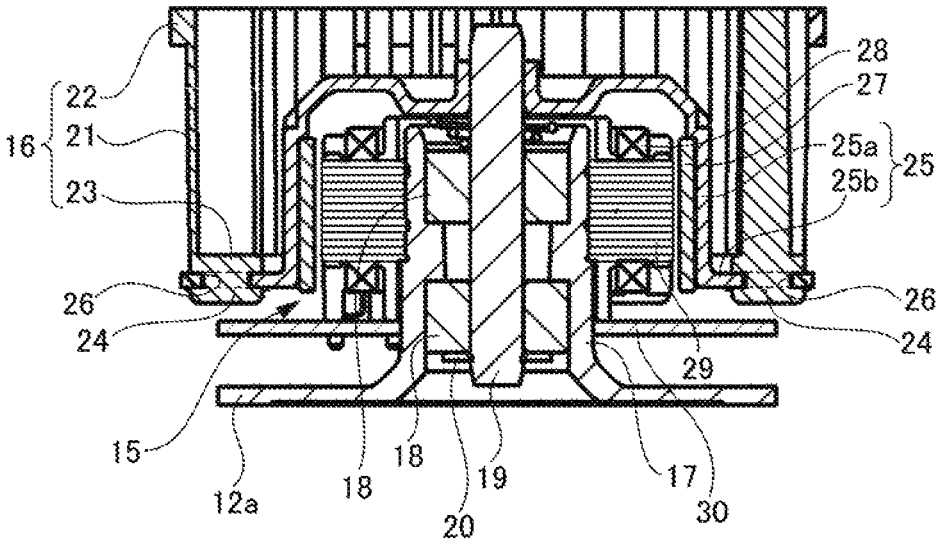
FIG. 2 is a cross-sectional view showing a structure of a motor and an impeller of the centrifugal blowing fan specified above.
Figure 3:
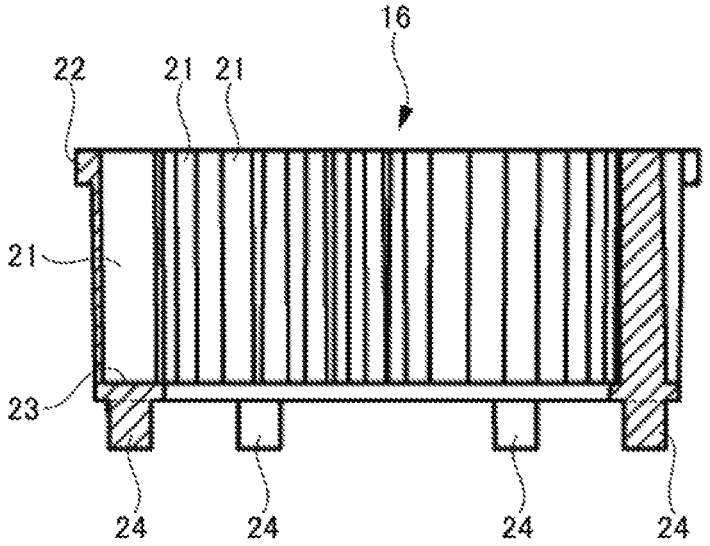
FIG. 3 is a cross-sectional view of the impeller of the centrifugal blowing fan specified above.

As shown in FIG. 2, a cylindrical bearing housing 17 is provided in the body 12*a* of the casing 12. Outer rings of two bearings 18, 18 are respectively supported at the inner side of the bearing housing 17, and a rotating shaft 19 of the motor 15 is supported in the inner rings of bearings 18, 18. A ring 20 is mounted on the lower end of the rotating shaft 19, which prevents the rotating shaft 19 from dropping out and positions the in axial direction.

The impeller 16 is made from synthetic resin and comprises integrally a plurality of blades 21 arranged in circumferential direction, an annular collar 22 consisting by joining one of the ends of the plurality of blades 21 and a doughnut-shaped disk portion 23 formed flat from the inner circumference towards the outer circumference consisting by joining the other ends of the plurality of blades 21, wherein the impeller is formed cylindrically by injection molding. Further, during the injection molding, a plurality of protrusions 24 (six protrusions in this embodiment) with a circular cross section are formed on the lower surface of the disk portion 23 (hereafter meaning the surface opposing to the flange portion 25*b*) integrally with the disk portion 23, in circumferential direction and at virtually equal distances.

Figure 4:
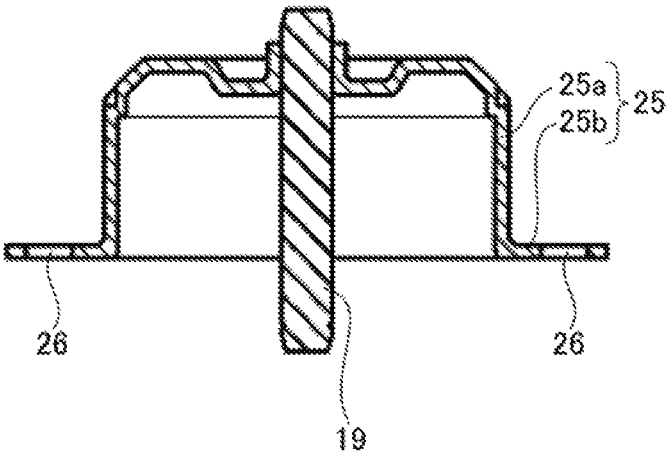
FIG. 4 is a cross-sectional view of a back yoke and a rotating shaft of the motor of the centrifugal blowing fan specified above.

The back yoke 25 is made from metal, being formed by press work virtually cylindrical with a bottom, whereat a flange portion 25*b* extending in outer direction virtually perpendicular to the outer surface is provided integrally at the edge or the circumference of an opening. The outer diameter of the cylindrical portion 25*a* of the back yoke 25 is formed smaller than the inner diameter of the impeller 16, a wide fitted space is provided between the inner surface of the impeller 16 and the outer surface of the back yoke 25, whereat the outer diameter of the flange portion 25*b* is formed with the same size as the outer diameter of the disk portion 23 of the impeller 16 or a little larger. Further, a rotating shaft 19 is directly inserted in the central portion of the cylindrical portion 25*a* of the back yoke 25, as shown in FIG. 2 and FIG. 4, so that the back yoke 25 and the rotating shaft 19 are integrated. Further, a plurality of holes 26 (six holes in this embodiment) from top through bottom are formed on the flange portion 25*b* on the circumferential diameter, which is virtually as same as that of the protrusions 24 of the disk portion 23 of the impeller 16, at same distances.

Figure 5A:
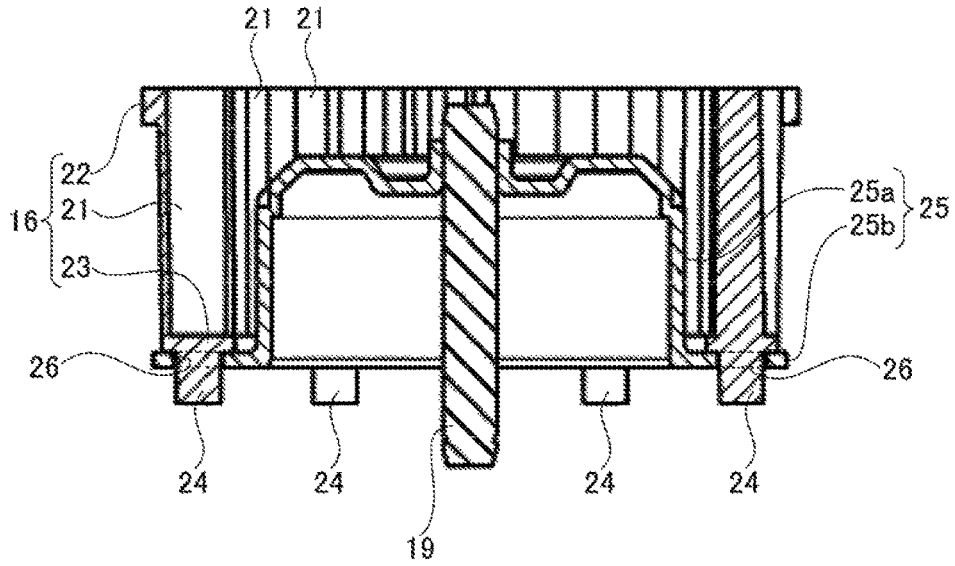
FIG. 5(*a*) is a cross-sectional view to explain a state that the back yoke and the impeller of the centrifugal blowing fan specified above before fixedly connected.
Figure 5B:
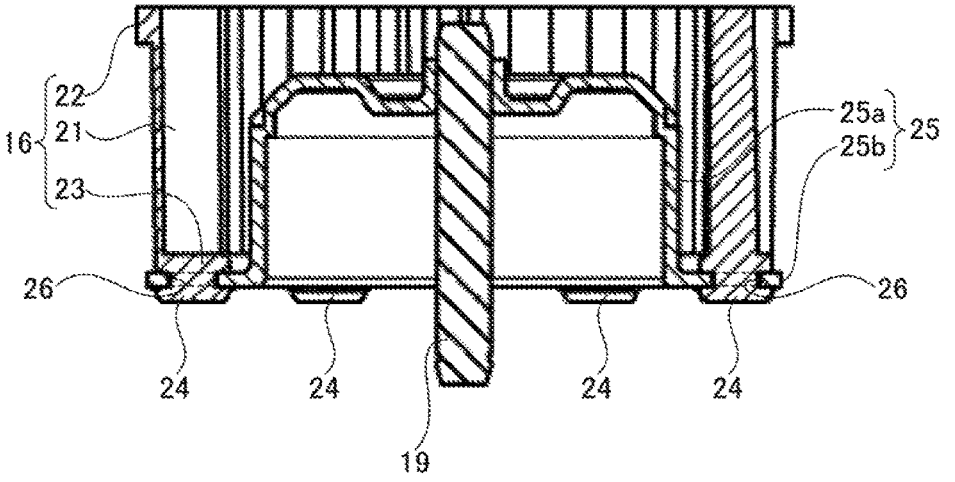
Figure 6:
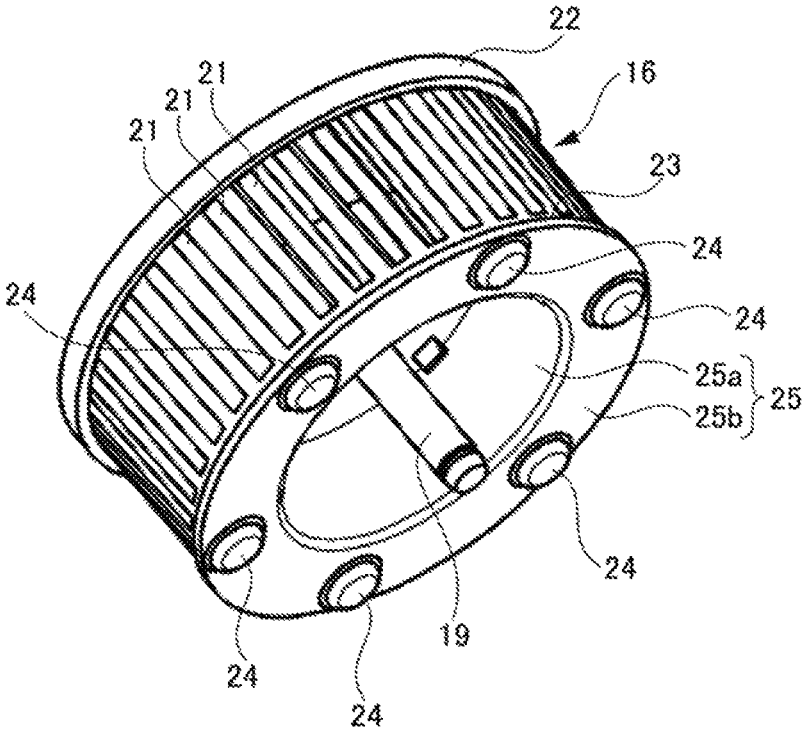
FIG. 6 is a perspective view showing a state after fixedly connected between the back yoke and the impeller of the centrifugal blowing tan specified above.

When back yoke 25 and impeller 16 are assembled, the protrusions 24 at the side of the impeller 16 are engaged with the holes 26 of the flange portion 25*b*, as shown in FIG. 5(*a*), and the tip portions of the protrusions 24, which slightly protrude from the back surface of the flange portion 25*b* are heat melted and than fixed by caulking, whereby the impeller 16 and the back yoke 25 are concentrically arranged with the rotating shaft 19 to be integrated. FIG. 2, FIG. 5(*b*) and FIG. 6 show a status at which the fixing by thermal caulking is completed, and thus the rotating shall 19, the impeller 16 and the back yoke 25 are concentrically fixed and connected and thereby integrated. It should be mentioned that the fixing by caulking of the protrusions 24 is not limited to a fixing by thermal caulking, but a cold caulking is also possible.

Turning back to FIG. 2, a ring-shaped magnet 27 is fixed to the inner circumference of the above-mentioned back yoke 25 by adhesion, whereat the rotating shaft 19, the back yoke 25 and the magnet 27 together form the rotor portion of the motor 15. A stator core 29 provided with stator windings 28 is fixed on the outer circumference of the bearing housing 17, defining the fixed portion of the motor 15. That is, the motor 15 shown here is an outer rotor type motor, whereat the rotor portion is rotatably arranged at the outer side of the fixed portion together with the impeller 16, with the rotating shaft 19 in the center. Further, a PC board 30, on which by means of electronic components an electronic circuit as brushless motor is built, is mounted below the stator core 29 (i.e. below the stator 29 shown in FIG. 2).

The electronic circuit comprising the PC board 30 controls the current to rotate the rotating portion of the motor 15 against the fixed portion of the motor 15. The stator windings 28 and the electronic circuit integrated into the PC board 30 are connected by lead wires not shown. Further, also not shown lead wires are connected to the PC board 30, through which current is supplied to the PC board 30.

In the thus structured centrifugal blowing fan 11, the fact is, that when an external current is supplied to the electronic circuit of the PC board 30, a driving current is supplied to the stator windings 28 of the fixed portion, through control of the electronic circuit, whereby the rotating portion consisting of the rotation shaft 19, the back yoke 25, the magnet 27 and so on rotates together with the impeller 16. Then, when the impeller 16 rotates, air is taken in from the air inlet 13, towards the axial direction of the rotating shaft 19, into the impeller 16. Further, the air taken into the impeller 16 is forwarded to the radial direction of the impeller 16 by centrifugal force caused by rotation of the blades 21 of the impeller 16, passes through the air outlet 14 and is then exhausted to the outside of the casing 12. Thus, by turning the air outlet 14 to the designated direction, the centrifugal blowing fan 11 can blow the air towards that direction.

Therefore, in case of the centrifugal blowing fan 11 according to this embodiment, the fact is, that protrusions 24 serving as fittings provided on the disk portion 23 of the impeller 16 are inserted in holes 26 serving as fitted spaces provided on the flange portion 25*b* of the back yoke 25, then, the tip portions of the protrusions 24 which protrude from the back surface of the flange portion 25*b* an fixed by caulking, so that under conformity of the central axis of the impeller 16 with the central axis of the back yoke 25, the impeller 16 and the back yoke 25 can be easily integrated together with the rotating shaft 19, without applying the conventional structure at which the back yoke was covered with an accommodation made from resin to be thereby integrated with the impeller.

Further, it is the fact, that the flange portion 25*b* of the back yoke 25 made from metal and the holes 26, which are the fitted spaces, are formed by press work, and the protrusions 24, which are the fittings of the impeller 16 made from resin, are formed by injection molding, integrally with the back yoke and the impeller, respectively, wherefore the back yoke 25 and the impeller 16 can be easily aligned against the rotating shaft 19 of the motor 15.

Further, in the structure of this centrifugal blowing fan 11, it is the fact, that by providing a flange portion 25*b* on the back yoke 25 made from metal, and abutting and mounting a disk portion 23 of the impeller 16 on this flange portion 25*b*, the inner surface of the impeller 16 is separated from the outer surface of the cylindrical portion 25*a* of the back yoke 25, and since a wide fitted space is provided between the inner surface of the impeller 16 and the outer surface of the back yoke 25, air can be absorbed through the air inlet 13 to the fitted space between the impeller 16 and the back yoke 25 smoothly, whereby the blowing rate can be increased. Further, by separating the impeller 16 from the back yoke 25, the impeller 16 is separated from the stator windings 28 which are the source of heat. Therefore, thermal damage of the impeller 16 is prevented, which makes usage under severe environment possible. Further, since the disk portion 23 of the impeller 16 is directly mourned on the flange portion 25*b*, it is possible to do away the excessive resin to be arranged around the outer surface of the back yoke 25, which used to be a problem with a conventional blowing fan.

Further, in the structure of this centrifugal blowing fan 11, it is the fact, that as long as there is consistency with the diameter of the flange portion 25*b*, it is possible to comply with various products (e.g. products of different types such as sirocco types or turbo types, products with different flow rate, products with different blade height), by only replacing the impeller 16, without changing the structure of the motor 15.

In this embodiment, the fact is, that the holes in the flange portion of the back yoke made from metal can be formed by press work, and the protrusions of the impeller made from resin can be formed by injection molding, integrally with the back yoke or the impeller, respectively. Further, when the protrusions of the impeller are fitted to the holes in the flange portion of the back yoke, and the protrusions protruding from the back surface are fixed by caulking, the impeller is tightly fixed and connected under consistency of its central axis with the central axis of the back yoke. Thus, back yoke and impeller can be aligned against the rotating shaft of the motor and be integrated easily, wherefore manufacturing can be simplified. As a result, costs can be reduced and product quality can be increased.

Next, a second embodiment of a structure for fixing and connecting the back yoke with the impeller in a centrifugal blowing fan of the present invention will be described with reference to FIG. 7 and FIG. 8. Portions identical or equivalent to those shown in FIGS. 1 to 6 will be assigned with the same number and not be explained again. In the following, mainly the differences between the above described embodiments in view of FIG. 5(*a*) and FIG. 5(*b*) and FIG. 6 will be explained.

Figure 7:
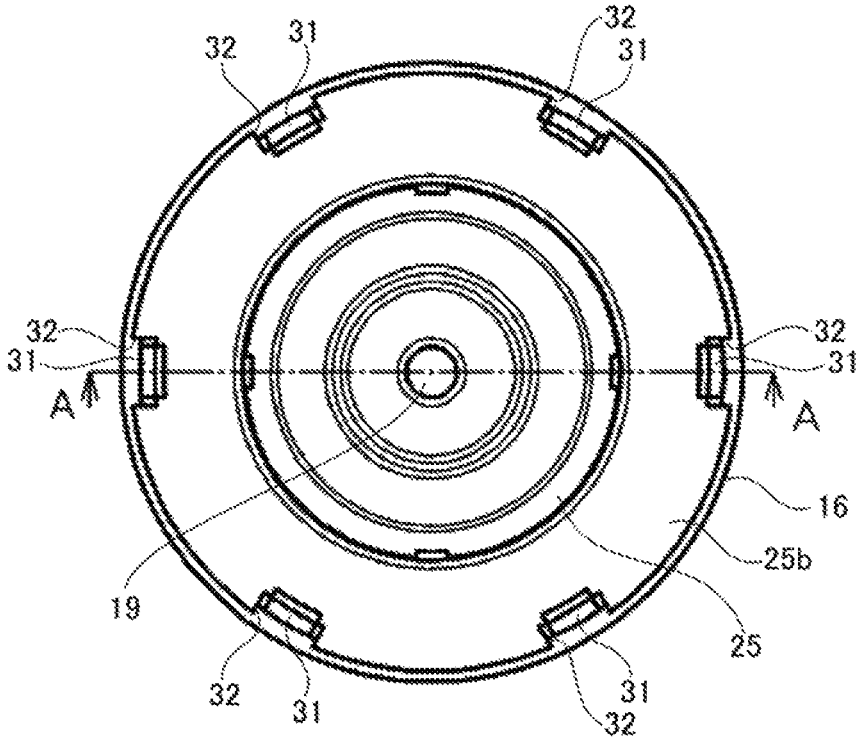
FIG. 7 is a bottom view showing a second embodiment of a structure wherein the back yoke and the impeller of the centrifugal blowing fan specified above are fixedly connected.
Figure 8:
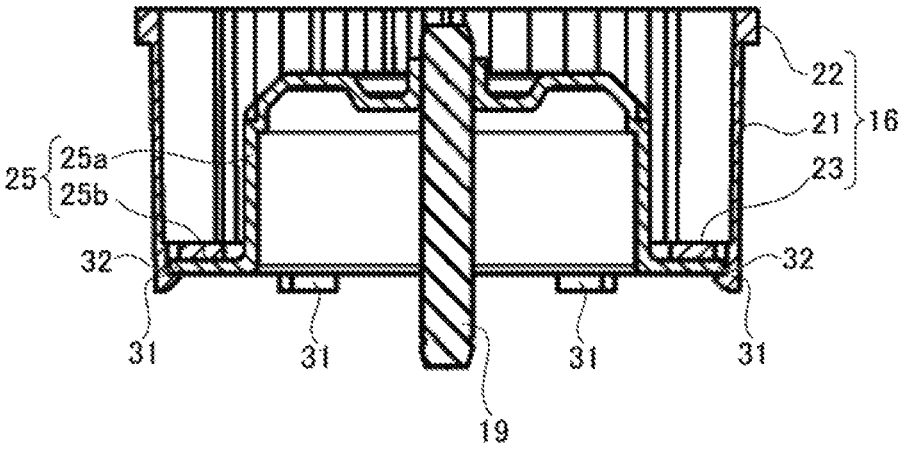
FIG. 8 is a cross-sectional view of A-A line of FIG. 7.

FIG. 7 is a bottom view showing a status wherein the back yoke 25 and the impeller 16 are fixed and connected, and FIG. 8 is a cross-sectional view of A-A line of FIG. 7. In this embodiment, there are provided key-shaped claws 31 as fittings on the disk portion 23 at the side of the impeller 16, and the flange portion 25*b* of the back yoke 25 is provided with notches 32 as fitted spaces into which the key-shaped claws 31 are inserted.

With the key-shaped claws 31 in the side of the disk portion 23, it is the fact, that while the impeller 16 is injection molded, a plurality of such claws (six claws in this embodiment) are at the same time formed on the outer circumference of the disk portion 23 of the impeller 16 starting from the lower surface of the disk portion 23 toward the lower side (in abutting direction with the flange portion 25*b*), as shown in FIG. 8, as claws having an L-shaped cross section facing inward, as shown in FIG. 7, the claws being formed in circumferential direction at virtually equal distances, integrally with the disk portion 23.

On the other hand, with the notches 32 at the back yoke 25, it is the fact, that while the back yoke 25 is press work, a plurality of such notches (six notches in this embodiment) are at the same time formed on the circumferential edge of the flange portion 25*b* of that back yoke 25, on the circumferential diameter which is virtually as same as that of the key-shaped claws 31 on the disk portion 23 of the impeller 16 that means in a size at which the key-shaped claws 31 can be fitted, as shown in FIG. 7, the notches being formed at virtually equal distances.

In this structure, it is the fact, that when the key-shaped claws 31 of the impeller 16 are pushed into the notches 32 of the flange portion 25*b*, the tip portions of the claws 31 abut with the flange portion 25*b* and are elastically deformed toward the outside, thereby evading. When they are further pushed in and the tips of the claws reach the back surface of the flange portion 25*b*, the elastic force of the claws 31 is reset and the tips of the claws are engaged with the back surface. Hereby, the impeller 16 and the back yoke 25 are concentrically, tightly and easily fixed and connected together with the rotating shaft 19 under consistency with the central axis. This status is shown in FIG. 7 and FIG. 8.

Though this embodiment discloses a structure whereat notches 32 are provided at the flange portion 25*b* of the back yoke 25, it is also possible to provide holes, instead of notches 32, into which the claws 31 are to be inserted.

In this embodiment, the fact is, that the notches or the holes in the flange portion of the back yoke made from metal can be formed by press work, and the key-shaped claws of the impeller made from resin can be formed by injection molding, integrally with the back yoke or the impeller, respectively. Further, when the claws of the impeller are pushed and snapped into the notches or holes of the flange portion, the claws are engaged with the flange portion, and the impeller is tightly fixed and connected under consistency of its central axis with the central axis of the back yoke. Thus, back yoke and impeller can be aligned against the rotating shaft of the motor and be integrated easily, wherefore manufacturing can be simplified. As a result, costs can be reduced and production quality can be increased.

Next, a third embodiment of a structure for fixedly connecting a back yoke with an impeller in a centrifugal blowing fan of the present invention will be described with reference to FIG. 9 and FIG. 10(*a*) FIG. 10(*b*) FIG. 10(*c*) FIG. 10(*d*). In subsequent description, members, portions or parts identical or corresponding to those shown in FIGS. 1 to 6 will be not repeated by assigning the same reference signs thereto. The differences from the first embodiment described above as shown in FIG. 5(*a*) and FIG. 5(*b*) and FIG. 6 will be mainly explained.

Figure 9:
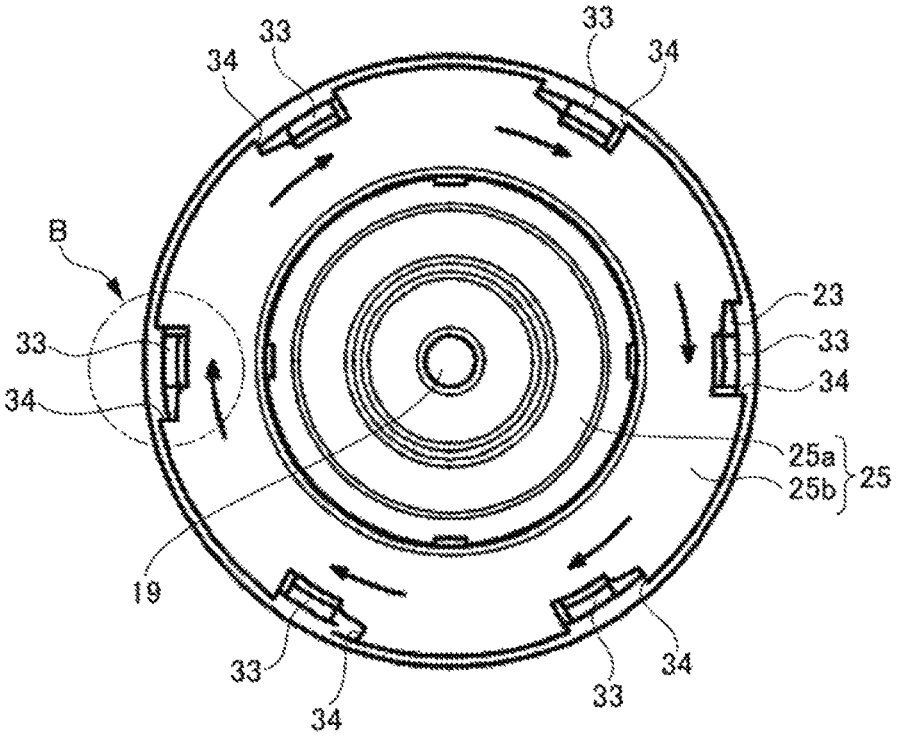
FIG. 9 is a bottom view showing a third embodiment of a structure to wherein the back yoke and the impeller of the centrifugal blowing fan specified above are fixedly connected.
Figure 10A:
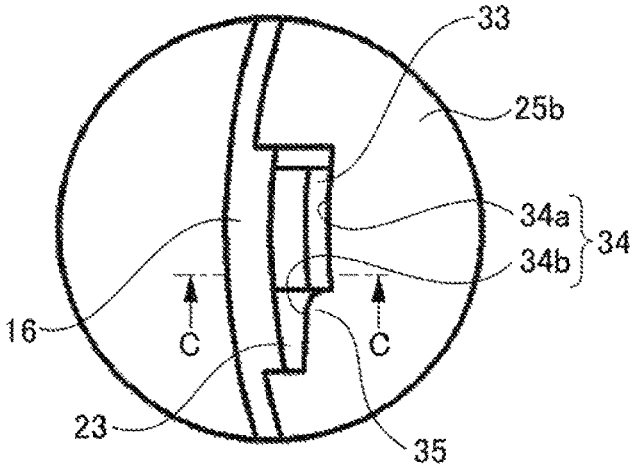
FIG. 10(*a*) is an enlarged view of circled B of FIG. 9, showing a state just before fixedly connected.
Figure 10B:
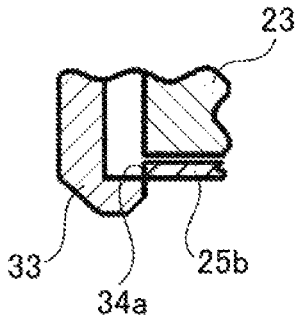
Figure 10C:
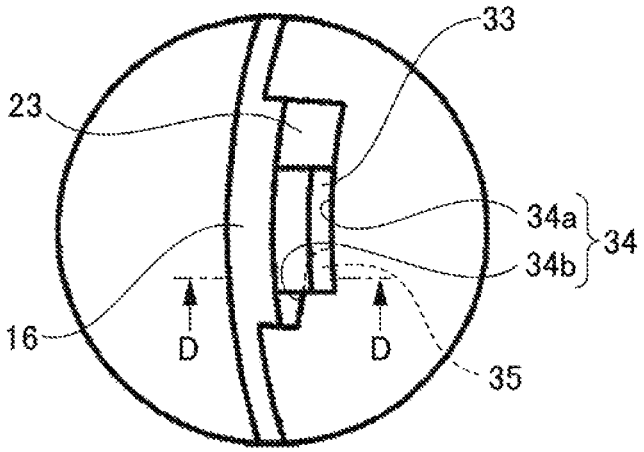
Figure 10D:
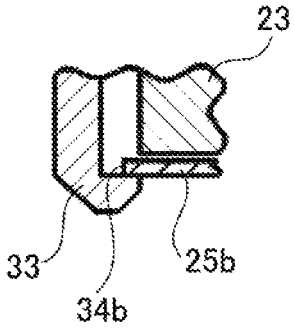

FIG. 9 is a bottom view showing a state just before fixedly connecting the back yoke 25 and the impeller 16. FIG. 10(*a*) FIG. 10(*b*) FIG. 10(*c*) FIG. 10(*d*) is an enlarged view of circled B of FIG. 9. In this embodiment, locks 33 as fittings are provided on the disk portion 23 of the impeller 16, while notches 34 as fitted spaces are provided in the flange portion 25*b* of the back yoke 25 to receive the locks 33.

The locks 33 of the disk portion 23, while the impeller 16 is injection-molded, are formed simultaneously and integrally with the impeller 16 in plurality (six locks in this embodiment) on the outer circumference of the disk portion 23 of the impeller 16 at substantially equal distances in circumferential direction, in such a way that the locks protrude from the lower surface of the disk portion 23 toward the lower side (in abutting direction with the flange portion 25*b*) in a key shape respectively having an L-shaped cross section facing inward (toward the side of the rotating shall 19). The distance between the upper surfaces of the locks 33 (hereafter, this term refers to the inner flat surfaces of the key-shaped pieces which abut with back surface of the flange portion 25*b*) and the lower surface of the disk portion 23 is virtually as same as the thickness (wall thickness) of the flange portion 25*b*.

With the notches 34 at the side of the back yoke 25, it is the fact, that while the back yoke 25 is press work, a plurality of such notches (six notches in this embodiment), provided with first notches 34*a* having a slightly smaller outer diameter than the inner diameter of the locks 33 on the disk portion 23 of the impeller 16 and a slightly larger circumferential diameter than the locks 33, and second notches 34*b* which are formed at an outer circumferential diameter slightly larger than the inner diameter of the blocks 33 in continuance with the first notches 34*a*, are formed on the edge of the outer circumference of the flange portion 25*b* of the back yoke 25 at distances virtually as same as the distances between the blocks 33 of the disk portion 23.

In this structure, it is the fact, that when the locks 33 of the impeller 16 are corresponded the first notches 34*a* and the disk portion 23 is abutted to the flange portion 25*b*, the stopping portions 33 will smoothly be fitted in the notches 34. FIG. 9, FIG. 10(*a*) and FIG. 10(*b*) show this status, whereat in this status, the upper surfaces of the locks 33 are located at a location virtually as same as the location of the lower surface of the flange portion 25*b* (lower part in FIG. 10(*b*)), or at the slightly lower side. Then, when the back yoke 25 is rotated around the center of axis in direction of the arrow shown in FIG. 9, the second notches 34*b* are moved to a location corresponding to the locks 33, as shown in FIG. 10(*c*) and FIG. 10(*d*), the locks 33 will be arranged at the lower surface of the flange portion 25*b*, and the flange portion 25*b* will be sandwiched between the upper surfaces of the locks 33 and the lower surface of the disk portion 23. By this sandwiching, the impeller 16 and the back yoke 25 are concentrically, tightly and easily fixed and connected together with the rotating shaft 19 under consistency with the central axis. Therefore, also in this embodiment, manufacturing can be simplified, costs can be reduced and quality can be increased. The same applies when the impeller 16 is rotated against the back yoke 25 instead of making the back yoke 25 rotate against the impeller 16.

Also in the embodiment shown in FIG. 9 and FIG. 10(*a*) FIG. 10(*b*) FIG. 10(*c*) FIG. 10(*d*), the notches 34 to be provided in the sleeve portion 25*b* of the back yoke 25 may instead be formed as holes provided with portions of first notches 34*a* and portions of second notches 34*b*.

To provide a smooth rotation of the back yoke 25, so that the flange portion 25*b* and the locks 33 do not collide, it is preferable to provide the end surfaces of the locks 33, which correspond with the place where the first notches 34*a* and the second notches 34*b* are linked (hereafter referred to as "linkage 35") with a radially curved surface or inclined surfaces inclining toward the linkage 35.

Further, it is possible to make a configuration such that the distance between the upper surfaces of the locks 33 and the lower surface of the disk portion 23 is, at the side of the end surfaces corresponding with the linkage 35, larger than the thickness (wall thickness) of the flange portion 25*b*, to make this distance gradually getting narrow toward the rotating direction of the back yoke 25, so that as a result of the rotation of the back yoke 25, the flange portion 25 is sandwiched between the upper surfaces of the locks 33 and the lower surface of the disk portion 23 in a pressed manner. This allows the impeller and the back yoke 25 being connected even stronger.

In this embodiment, the fact is, that the notches or the holes in the flange portion of the back yoke made front metal can be formed by press work, and the locks on the fittings of the impeller made from resin can be formed by injection molding, integrally with the back yoke or the impeller, respectively. Further, when the claws of the impeller are fitted to the notches or the holes of the flange portion, and the back yoke is rotated, the locks or the impeller are engaged with the notches or the holes of the back yoke, the impeller is tightly fixed and connected under consistency of its central axis with the central axis of the back yoke. Thus, back yoke and impeller can be aligned against the rotating shaft of the motor and be integrated easily, wherefore manufacturing can be simplified. As a result, costs can be reduced and production quality can be increased.

In integrally speaking through the above embodiments, the fact is, that by joining fittings which are provided on the disk portion of the impeller to the flange portion of the back yoke, it becomes possible to integrate impeller and back yoke by tightly fixing and connecting the two, without adopting the conventional structure wherein the back yoke was covered by an accommodation made from resin create a connection with the impeller. Further, since the back yoke is not covered with an accommodation made from resin, it is possible to prevent thermal damage of impeller and back yoke, wherefore the quantity of resin for the impeller is reduced and weight can be saved. Further, since the disk portion of the impeller is directly mounted on the flange portion of the back yoke made from metal, arranging excessive resin around the outer surface of the back yoke is no more necessary. Furthermore, it becomes possible to form a wide fitted space between the inner circumference of the impeller and the outer circumference of the back yoke.

Repeatedly enumerating the above embodiments according to the present invention provide the following effects:

(1) By not covering the back yoke with the accommodation made from resin, the impeller and the back yoke can be prevented from thermal damage, and thus they can be in use under severe environment.

(2) The amount of resin for the impeller can be reduced whereby weight can be saved and costs can be reduced as well.

(3) Since it is no more necessary to arrange excessive resin around the outer circumference of the back yoke, it is possible to provide a wide fitted space between the inner circumference of the impeller and the outer circumference of the back yoke, wherefore the blowing capability can be enhanced by increasing the air blowing rate.

(4) Since the flange portion of the back yoke made from metal can be formed by press work, and the fittings of the impeller made from resin can be formed by injection molding, forming integrally with the back yoke or the impeller integrally, respectively, is possible. Thus, back yoke and impeller can be aligned against the rotating shaft of the motor easily, wherefore manufacturing can be simplified. As a result, costs can be reduced and product quality can be increased.

(5) Back yoke and flange portion are integral, and since the impeller is fixed and connected to this flange portion, the driving force can easily be transferred to the impeller.

(6) By providing the back yoke with a flange portion and mounting the impeller on the flange portion, impeller and back yoke can be joined at a position which is away from the stator windings of the motor, which is the source of heat. Therefore, there is no danger of deformation and/or damage on the impeller, thus increasing the reliability.

(7) The invention can be realized without changing the conventional number of parts and assembly work.

(8) As long as there is consistency with the flange portion diameter, it is possible to comply with various products (e.g. products of different types such as sirocco types or turbo types, products with different flow rate, products with different blade height), by only replacing the impeller, without changing the structure of the motor.

The present invention is not limited to the above embodiments described above, and other embodiments and/or modifications are also included as long as the scope of the invention claimed can be achieved.

REFERENCE SIGNS LIST

11 . . . centrifugal blowing fan, 13 . . . air inlet, 14 . . . air outlet, 15 . . . motor, 16 . . . impeller, 19 . . . rotating shaft, 21 . . . blade, 22 . . . annular collar, 23 . . . disk portion, 24 . . . protrusion (fitting), 25 . . . back yoke, 25*a* . . . cylindrical portion, 25*b* . . . flange portion, 26 . . . hole (fitted space), 27 . . . magnet, 28 . . . stator winding, 31 . . . claw (fitting), 32 . . . notch (fitted space), 33 . . . lock (fining), 34 . . . notch (fined space), 34*a* . . . first notch, 34*b* . . . second notch, 35 . . . linkage

The invention claimed is:

1. A centrifugal blowing fan comprising:

a casing having an air inlet and an air outlet;

a motor disposed in the casing, the motor comprising:

a rotating shaft, a back yoke made of a metal having a cylindrical portion and a flange portion disposed around a periphery of an opening of the cylindrical portion, wherein a plurality of holes are provided with the flange portion, and a magnet attached with an inner surface of the cylindrical portion of the back yoke; and an impeller disposed in the casing and made of a resin comprising:

a plurality of blades circumferentially arranged, and at least one portion which is able to abut with the flange portion of the back yoke and is provided with a plurality of protrusions, wherein each of the protrusions is able to be inserted through each of the holes, and each tip of the protrusions protruded from a lower side surface of the flange portion toward a lower direction opposite to the air inlet of the casing along an axial direction of the rotating shaft, wherein each tip of the protrusions is able to be swaged so that the impeller is connected with the flange portion of the back yoke, and wherein the flange portion of the back yoke has an outer diameter which is equal to or larger than an outer diameter of the at least one portion of the impeller.

2. The centrifugal blowing fan according to claim 1, wherein the plurality of protrusions are integrally formed with the at least one portion of the impeller.

3. The centrifugal blowing fan according to claim 1, wherein the width of each protrusion which protrudes from the lower side surface of the flange portion is larger than the width of the corresponding hole when swaged.

4. The centrifugal blowing fan according to claim 1, wherein each lower end of the plurality of blades is located higher than the flange portion of the back yoke with respect to the axial direction of the rotating shaft.

* * * * *